United States Patent [19]

Braunisch et al.

[11] Patent Number: 4,956,531

[45] Date of Patent: Sep. 11, 1990

[54] MICROWAVE OVEN WITH ADAPTABLE POWER MODULE

[75] Inventors: Eckart Braunisch, Kimstad; Jan Önnegren, Norrköping, both of Sweden

[73] Assignee: U.S. Philips Corporation, New York, N.Y.

[21] Appl. No.: 372,572

[22] Filed: Jun. 27, 1989

[30] Foreign Application Priority Data

Jul. 6, 1988 [SE] Sweden ..... 8802528

[51] Int. Cl.[5] ..... H05B 6/64

[52] U.S. Cl. ..... 219/10.55 B; 219/10.55 F; 219/10.55 R; 126/21 A; 361/384

[58] Field of Search ..... 219/10.55 B, 10.55 R, 219/10.55 D, 10.55 E, 10.55 F; 126/21 R, 21 A; 361/383, 384

[56] References Cited

U.S. PATENT DOCUMENTS

| | | | |
|---|---|---|---|
| 3,829,647 | 8/1974 | Igarashi | 219/10.55 R |
| 3,849,623 | 11/1974 | Gilliatt | 219/10.55 R |
| 4,091,252 | 5/1978 | Koinuma | 219/10.55 R |
| 4,100,463 | 7/1978 | Sugie | 219/10.55 R |
| 4,184,945 | 1/1980 | Morgan et al. | 219/10.55 D |
| 4,556,772 | 12/1985 | McCammon et al. | 219/10.55 F |
| 4,849,592 | 7/1989 | Claesson | 219/10.55 F |

FOREIGN PATENT DOCUMENTS 2003007 2/1979 United Kingdom .

*Primary Examiner*—Philip H. Leung
*Attorney, Agent, or Firm*—Bernard Franzblau

[57] ABSTRACT

A microwave oven includes an oven cavity, into which HF power is fed from a microwave source, e.g. a magnetron energized by a power supply device. The power supply device with its components and the microwave source are cooled with the aid of a fan. The power supply device, the microwave source (12) and the fan (11) are combined into a so-called power module, which includes a substantially closed envelope (10) having an air inlet (15) and an air outlet (16), an input for the AC supply voltage and an output for HF power (30). The microwave source is mounted as a projecting part of the envelope at the air inlet or the air outlet of the power module. This makes it possible to adapt the power module to a great number of microwave oven constructions. The power module may be mounted at the top or bottom of the oven cavity or at the side of same. Feeding microwave energy into the oven cavity is possible both at the top and bottom thereof.

16 Claims, 2 Drawing Sheets

MICROWAVE OVEN WITH ADAPTABLE POWER MODULE

BACKGROUND OF THE INVENTION

This invention relates to a microwave oven comprising an oven cavity, a microwave source for feeding HF energy into the cavity, a power device for the supply of power to the microwave source and a fan for cooling the components of the power device, including the microwave source, the power device microwave source and the fan are combined into a unit, the so called power module, comprising a substantially closed envelope having an air inlet, an air outlet, an input for the AC supply voltage and an output for HF power coupled to the oven cavity. The envelope has an air channel between the air inlet and the air outlet for producing a forced cooling air stream by means of the fan, the components to be cooled being arranged in the path of the cooling air stream.

GB 2 003 007 discloses a power module for microwave ovens of the kind set forth in the first paragraph. The power module comprises a tubular housing containing a cooling fan, a microwave source and a power supply positioned in that order between an air inlet at one end of the tubular housing and an air outlet at the other end of the housing. The microwave source is situated at the midpoint of the housing and only the output antenna projects from the housing.

By means of a power module according to the above, it is achieved that the assembly of the microwave oven is less complicated and time consuming than when the components are mounted together directly in an oven. The power modules are tested before they are inserted in the oven, so that the risks of malfunctions of the oven when assemblyed are reduced almost to zero the use of this power module concept. However, the power module according to said British application is restricted in its use to one or possibly a few oven constructions due to the location of the microwave source and the output antenna.

SUMMARY OF THE INVENTION

It is an object of the invention to obtain a power module which is usable in a great number of oven constructions. The power module should be suitable for both top and bottom feeding of the oven and the power module should be mountable at the bottom or the top of the oven cavity as well as at the side of the same.

According to the invention this is achieved by means of a microwave oven which is characterized in that the microwave source is mounted as a projecting part of the envelope at the air inlet or air outlet of the power module, an antenna projecting from the microwave source forming the said HF output.

The mounting of the microwave source as a projecting part makes it possible to direct the microwave source in a desired direction by rotating the projecting part to a corresponding direction when mounting the projecting part. The microwave source may also be mounted in a non fixed manner so that it can be set with the antenna in different angular positions relative to the envelope. The power module can be made very compact and will require less total space as compared wtih the space required by the prior art power module.

In a preferred embodiment the fan is situated at the air inlet and the microwave source at the air outlet or vice versa.

In another preferred embodiment the fan likewise is mounted as a projecting part of the envelope.

The microwave source with its projecting antenna is preferably mounted in a non-fixed manner so that it can be adjusted to different angular positions relative to the envelope in order to bring the antenna into connection with a feeding system to the oven cavity. Then the power module can be used in different oven constructions, the setting of the microwave source being adapted to the oven construction and the position of the power module in the oven.

If the oven has a rotating, air-driven stirrer or antenna situated within the cavity, a very simple driving of the stirrer or antenna is achieved if the fan is arranged to produce an over-pressure in the envelope and this over-pressure is utilized for driving the rotating stirrer or antenna.

BRIEF DESCRIPTION OF THE DRAWING

The invention will be descried in great detail with reference to the accompanying drawings, in which.

DESCRIPTION OF THE PREFERRED EMBODIMENTS

Figure 1:
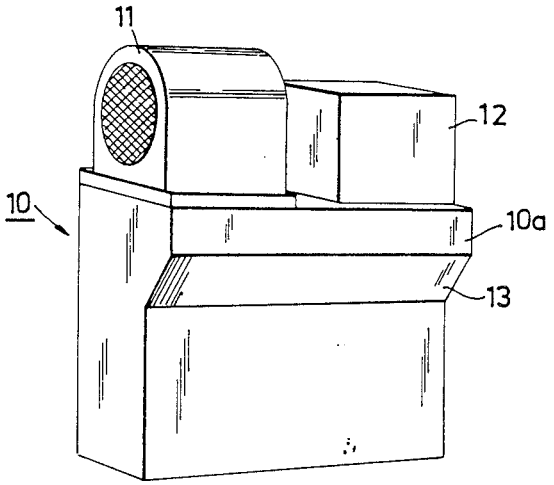
FIG. 1 shows a perspective view of a power module according to the invention.

The power module shown in FIG. 1 consists of a substantially closed metallic sheet envelope 10, supporting a fan 11 and a magnetron 12. The sheet envelope 10 is of substantially parallelepipedic shape and has a shoulder 13 so that the envelope will have a wider base part 10*a*, where the fan and the magnetron are mounted. In that side wall 14 of the sheet envelope, where the fan and the magnetron are mounted (see FIG. 2), there is an opening 15 forming an air inlet and an opening 16 forming an air outlet, the fan being mounted opposite the air inlet and the magnetron being mounted opposite the air outlet. The fan has its exhaust opening facing the envelope so that an over-pressure is produced within the envelope.

Figure 2:
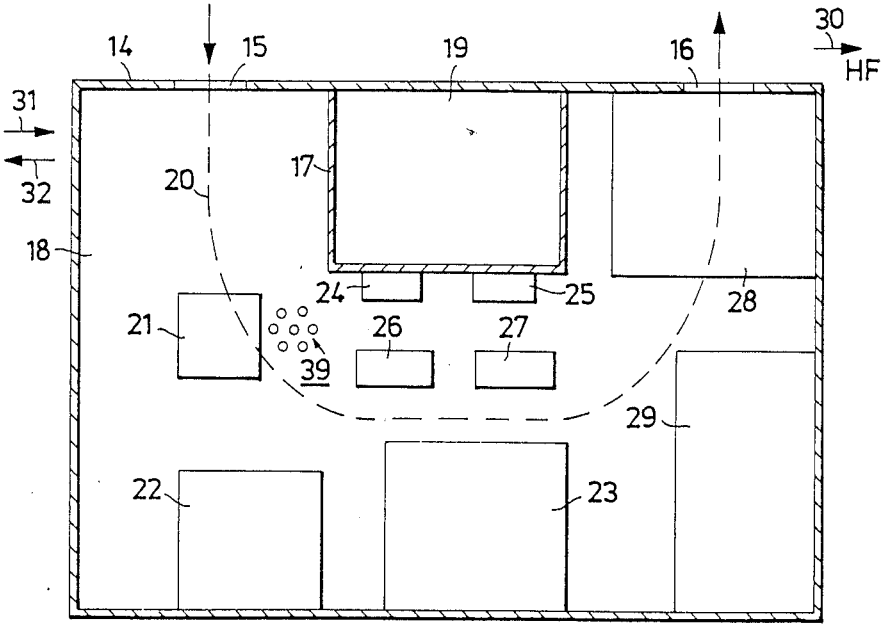
FIG. 2 shows a schematical sectional view through the module and some components to be cooled for the case where the power device is a Switch Mode Power Supply.

According to FIG. 2 the inside of the envelope 10 is provided with a cooling plate 17 extending from the said side wall 14, where the fan and the magnetron are mounted, and separating the inner volume of the envelope in to two parts, 18 and 19. That part 18 of the inside of the envelope, which has a connection with the air inlet and the air outlet, forms a U-shaped air channel for an air stream, which in the drawing is represented by the dashed line 20. Those components having the highest need for cooling are then placed in the part of the space 18 forming this air channel 20. Certain components having a smaller need for cooling can be placed in the space 19.

FIG. 2 shows an example of a possible positioning of some of the components to be cooled within the envelope 10 in the case where the supply device is a so-called Switch Mode Power Supply. In FIG. 2 reference numeral 21 designates a mains rectifier (fullwave rectifier), while 22 is a choke coil for the rectifier, 23 is a coil included in the resonance circuit of the power supply, 24 is a controllable thyristor included in the resonance circuit and serving as a switch in the resonance circuit and 25 is a power diode connected in series with the thyristor, 26 and 27 are two capacitors included in the resonance circuit, 28 is a transformer for generating the high voltage for the magnetron and 29 is a package of capacitors included in the drive circuit of the magnetron. The transformer 28 is in this example arranged inside the envelope and close to the air outlet 16, while the swtiching thyristor 24 and the power diode 25 are mounted directly on the cooling plate 17. Due to said layout all of the said components will get on effective cooling by the forced air flow 20 and the cooling plate 17.

Besides the said openings 15 and 16 forming the air inlet and air outlet, respectively, the power module also has a HF-output, in FIG. 2 represented by the arrow 30, which is preferably formed by the antenna of the magnetron mounted at the opening 16, and control inputs and outputs, represented by the arrows 31 and 32, for regulating the HF energy supply to the oven cavity.

Figure 3:
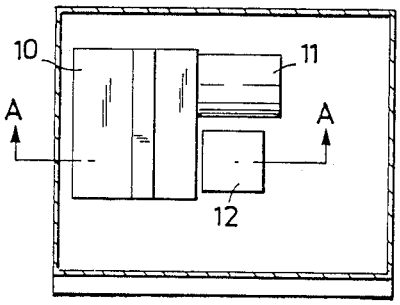
FIG. 3 shows a sectional view through a space situated above the cavity in a microwave oven with top-feeding and with a power module according to the invention mounted on the top of the cavity.
Figure 4:
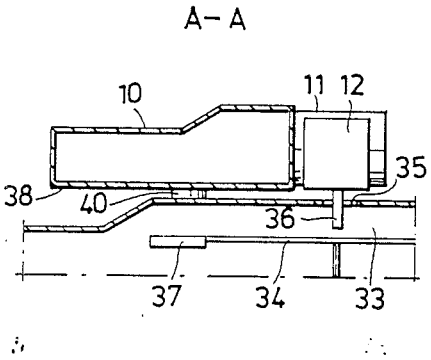
FIG. 4 shows a vertical sectional view through the power module and the cavity roof taken along the line A—A in FIG. 3.

FIG. 3 shows a sectional view through a space situated at the top of the cavity in a so-called single-wall oven, in which the supply of power to the cavity is effected via the cavity roof by means of a power module according to the inveniton. FIG. 4 shows a sectional view taken along the line A—A in FIG. 3. In this case the envelope 10 of the power module is mounted in such a position in parallel with the cavity roof that the magnetron is situated approximately at the centrum of the cavity roof. In the manner described in the Swedish patent application SE 8700399-2, which corresponds to U.S. Pat. No. 4,849,592 (7/18/89), the cavity roof is at this place provided with a groove shaped recess 33 forming a waveguide in combination with a rotatable conductive antenna or stirrer plate 34 situated outside the recess. At the centrum of the groove shaped recess 33 opposite the magnetron 12 there is a supply opening 35 in the bottom of the recess 33. The magnetron 12 is in this case mounted in such a way on the envelope 10 that its antenna 36 projects perpendicular to the broadside of the envelope and extends through the said opening 35 into the groove shaped recess 33. Microwave energy delivered by the magnetron antenna 36 will then propagate in the recess 33 and radiate into the cavity at the ends of same.

The rotating antenna or stirrer plate 34 is air-driven and is for this purpose provided with wings 37. The plate 34 is driven by the over-pressure within the envelope 10 of the power module, the rear side 38 of which facing the cavity roof being provided with a number of small apertures 39 (see FIG. 2). Opposite the apertures 39 in the envelope 10 the recess 33 has in its bottom a corresponding group of small apertures. An air channel 40 connecting the said aperture groups extends between the rear side 38 of the envelope 10 and the cavity roof. Hereby a small air stream will be led from the envelope 10 to the cavity for driving the antenna plate 34.

Figure 5:
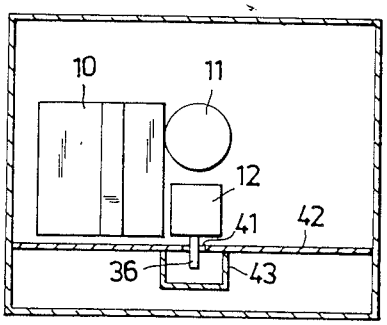
FIG. 5 shows a schematical vertical sectional view through a space situated at the side of the cavity in a microwave oven with power supply from below and having a power module according to the invention.

FIG. 5 shows a vertical sectional view through a space situated at the side of an oven cavity in a microwave oven fed from below and comprising a power module according to the invention. The envelope 10 of the power module is in this case mounted in a vertical position on the side wall of the cavity. The magnetron 12 is then rotated 90° as compared with the position in the foregoing example so that its antenna 36 projects from a short side of the envelope 10 and is directed vertically downwards. Opposite the magnetron antenna 36 there is an opening 41 in a bottom plate 42, which plate continues in the bottom plate of the cavity. Through the opening 41 the magnetron antenna 36 projects into a wave-guide 43 situated below the bottom plate 42, which waveguide extends to a supply opening for microwave energy in the bottom plate of the cavity. Power thus will be fed from the power module via the waveguide 43 to the oven cavity.

Many other positions of the power module in an oven envelope are possible, the angular setting of the magnetron being adapted to the actual oven construction and the positioning of the power module.

We claim:

1. A microwave oven comprising an oven cavity, a microwave source having an antenna projecting therefrom for feeding HF power into the oven cavity, a power supply device for the supply of power to the microwave source, a fan for cooling components of the power supply device and the microwave source; the power supply device, the microwave source and the fan being combined into a power module unit comprising a substantially closed envelope containing at least some of said components of the power supply device and haivng an air inlet, an air outlet and an input for AC supply voltage, the envelope having an air channel between the air inlet and the air outlet for passage of a forced cooling air stream produced by means of the fan, the components to be cooled being arranged in the path of the cooling air stream, the microwave source being mounted as a projecting part of the envelope at the air inlet or air outlet of the envelope and with the antenna projecting from the microwave source, said fan also being mounted as a projecting part of the envelope.

2. A microwave oven as claimed in claim 1, wherein the fan is situated adjacent the air inlet and the microwave source adjacent the air outlet or vice versa.

3. A microwave oven as claimed in claim 2, wherein said microwave source and said fan are mounted on a common outside wall of said envelope.

4. A microwave oven as claimed in claim 1, wherien the microwave source with its projecting antenna is mounted in a non-fixed adjustable manner so that it can be easily set with the antenna in different angular positions relative to the envelope for coupling the antenna to a HF power supply stream for the oven cavity.

5. A microwave oven as claimed in claim 4, wherein the air channel is formed by a cooling plate extending between the air inlet and the air outlet within the envelope and separating a part of the interior of the envelope from the rest of the interior of the envelope.

6. A microwave oven as claimed in claim 1, wherein the air channel is formed by a cooling plate extending between the air inlet and the air outlet within the envelope and separating a part of the inner interior of the envelope from the rest of the interior of the envelope.

7. A microwave oven as claimed in claim 6, further comprising a rotating air-driven stirrer or antenna situated within the oven cavity, wherein the fan is adapted to produce an over-pressure in the envelope and the over-pressure is utilized to drive the rotating stirrer or antenna.

8. A microwave oven as claimed in claim 1, further comprising a rotating air-driven stirrer or antenna situated within the oven cavity, wherein the fan is adapted to produce an over-pressure in the envelope which is utilized to drive the rotating stirrer or antenna.

9. A microwave oven as claimed in claim 1, wherein said air inlet and said air outlet are formed in a common wall of said envelope.

10. An integral power module assembly for use in a microwave oven comprising;

a microwave energy source having a casing from which an antenna projects for feeding high frequency power to an oven cavity, a power supply device for the microwave energy source which power supply device includes an envelope having an interior volume in which electric components thereof are mounted, said envelope also having an air inlet and an air outlet, a fan for cooling at least some of said electric components and said microwave energy source, said fan and said microwave energy source being connected to an external part of said envelope to form an integral assembly therewith and with said fan adjacent one of said air inlet and air outlet and said microwave energy source adjacent the other one of said air inlet and air outlet, the envelope interior having an air channel between the air inlet and the air outlet to pass a cooling air stream produced by the fan, and wherein the electric components to be cooled are mounted in or near the path of the cooling air stream.

11. An integral power module assembly as claimed in claim 10, wherein said microwave energy source is mounted on said envelope in a non-fixed adjustable manner so that its projecting antenna can be set to different angular positions relative to the envelope thereby to readily adapt the assembly for mounting to different types of microwave ovens for coupling said antenna to the oven cavity.

12. An integral power module assembly as claimed in claim 11, wherein said air inlet and said air outlet are formed in a common wall of said envelope.

13. An integral power module assembly as claimed in claim 12, wherein said microwave energy source and said fan are mounted on said common wall of the envelope.

14. An integral power module assembly as claimed in claim 10, wherein the interior of the envelope includes a cooling plate located between the air inlet and the air outlet to form a generally U-shaped air channel therebetween.

15. An integral power module assembly as claimed in claim 10, wherein said air inlet and said air outlet are formed in a common wall of said envelope.

16. An integral power module assembly as claimed in claim 10, wherein said microwave source and said fan are mounted on a common outside wall of said envelope.

* * * * *